United States Patent [19]

Hychalk

[11] 4,383,617

[45] May 17, 1983

[54] VEHICLE OUTRIGGER SUPPORT SYSTEM

[75] Inventor: Leonard V. Hychalk, Painted Post, N.Y.

[73] Assignee: Figgie International Inc., Richmond, Va.

[21] Appl. No.: 240,280

[22] Filed: Mar. 4, 1981

[51] Int. Cl.[3] ..... B66C 23/62

[52] U.S. Cl. ..... 212/189

[58] Field of Search ..... 212/189; 414/543; 280/763, 766

[56] References Cited

U.S. PATENT DOCUMENTS 3,021,016 2/1962 Noll et al. ..... 212/189

3,064,825 11/1962 Thomas ..... 212/189

4,071,147 1/1978 Hornagold ..... 212/189

*Primary Examiner*—Trygve M. Blix

*Assistant Examiner*—Jesus D. Sotelo

*Attorney, Agent, or Firm*—Harpman & Harpman

[57] ABSTRACT

An outrigger support system to provide lateral stability for vehicles such as fire engine ladder trucks employs extensible legs that are angled out sidewardly from the vehicle and movable downwardly into engagement with the ground. The legs are provided with movable lateral extensions on their lower ends to increase lateral stability. Power mechanisms are provided engaging the legs and lateral extensions to move them between retracted and extended positions.

8 Claims, 7 Drawing Figures

VEHICLE OUTRIGGER SUPPORT SYSTEM

BACKGROUND OF THE INVENTION

1. Technical Field

This invention relates to outriggers as used on certain types of wheeled vehicles such as fire engine ladder trucks employing movable extension ladders, booms or cranes, the vehicles being designed to travel under their own power along highways which limits their lateral dimensions. When set up for operation at a site the large extension ladders, booms, and the like are often extended laterally to the side of the vehicle and exert a moment on the vehicle that will tip over the vehicle or tilt the vehicle if no further lateral support is provided other than the wheels of the vehicle. To provide lateral stability to resist such tipping moment, it is common to use outrigger legs on one or both sides of the vehicle with each such leg employing telescoping housing with the housing permanently angled outwardly and downwardly or swung to such angled position about a pivot. The legs are telescoped downwardly from their housing into engagement with the ground outwardly of the wheels to provide stability. There are many occasions when such stability is not enough and the boom or ladder must therefore be lowered or the extension angle of the boom or ladder length reduced or the vehicle must be moved closer to the work area all to reduce the tipping moment to an acceptable level that can be handled by the existing outrigger structure. Further, to obtain whatever distance is obtained by the outrigger structure from the adjacent vehicle wheel line, the mechanisms are greatly restricted by the allowable beam or width of the vehicle as permitted by road traveling conditions or requirements.

2. Description of the Prior Art:

The prior art disclosing outrigger support systems is represented by U.S. Pat. Nos. 3,215,282 to Wiemann, et al, 3,276,603 to Noller and 3,985,036 to Decker, et al.

The disclosures of the Wiemann, et al and Noller patents relate to adjustable outriggers having telescopic legs. In the disclosures the inner leg members are manually pulled outwardly of the outer leg members and pins are inserted in aligned holes at the desired adjusted length. The leg assemblies are pivoted to the vehicles or implements on which they are mounted and are movable relative thereto by hydraulic or pneumatic means.

The Decker, et al disclosure relates to an outrigger system having outboard leg members which are pivotally mounted to inboard leg members. None of the prior art discloses the structure of the present outrigger support system and in particular the laterally movable extensions which substantially increase the outrigger support ability.

SUMMARY OF THE INVENTION

The present invention relates to an outrigger support system for a vehicle, such as a fire engine ladder truck or the like, which may be extended beyond its normal lateral positioning on those occasions where additional moment resistance is needed. The laterial extensions are movable and/or removably attached to the lower ends of the outrigger legs to extend horizontally outwardly away from the vehicle to increase the moment arm of the outrigger system. In the preferred form the lower end of each of the outrigger legs is provided with a horizontal plate which slidingly supports the outrigger extension for movement between an outward support position and an inward storage position.

DESCRIPTION OF THE PREFERRED EMBODIMENT

Figure 1:
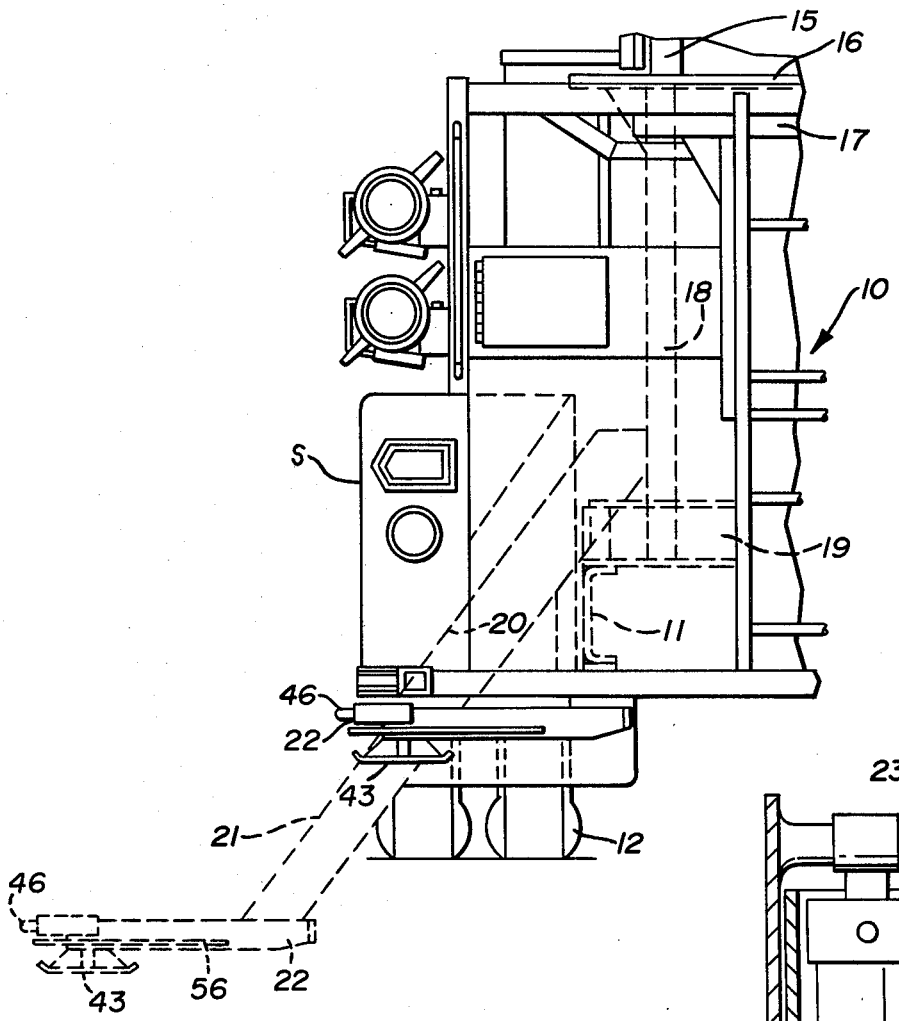
FIG. 1 is a rear elevation of a portion of a ladder supporting vehicle illustrating an outrigger support with a lateral extension, broken lines indicate the extended position of the device.
Figure 2:
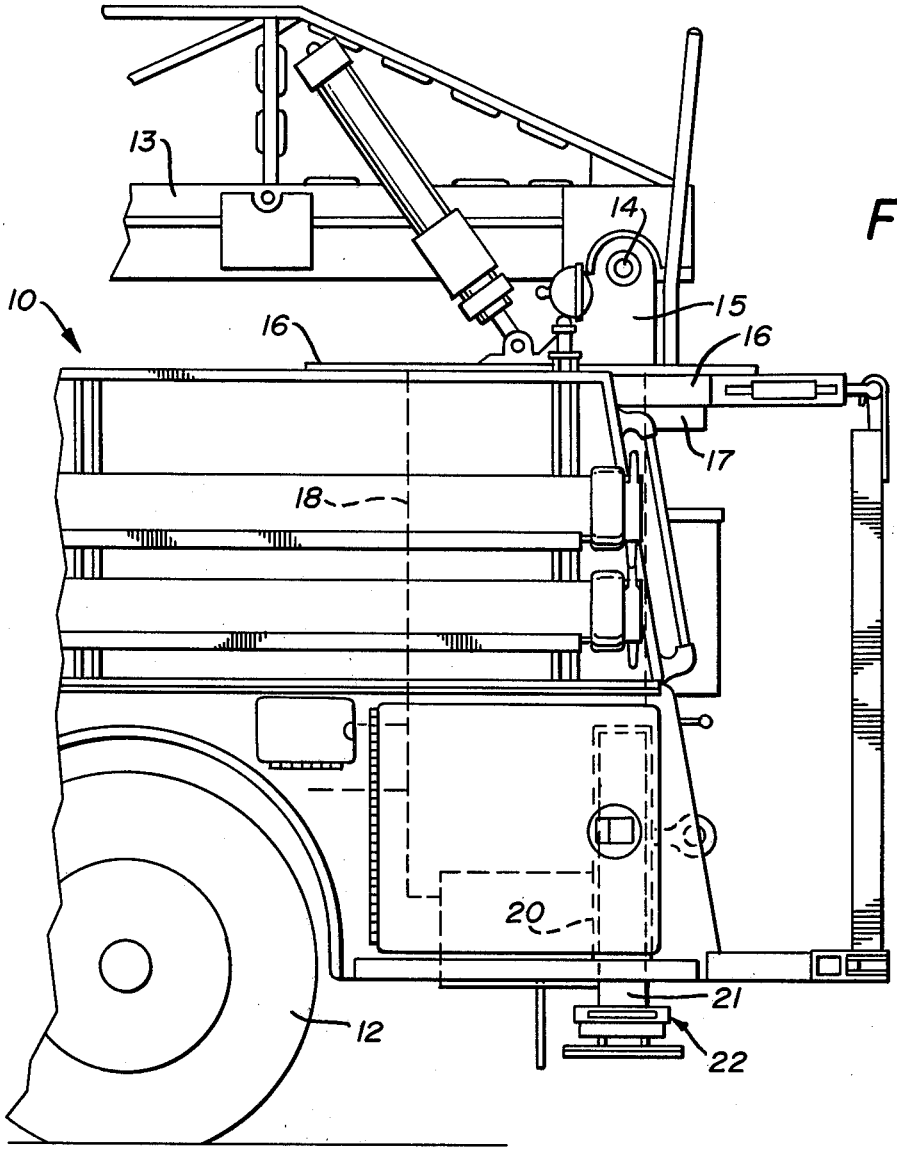
FIG. 2 is a side elevation of a portion of a ladder supporting vehicle showing the outrigger extension.

In the form of the invention chosen for illustration and description herein, the vehicle outrigger support system is illustrated in FIGS. 1 and 2 of the drawings on a vehicle 10 such as a fire engine having a movable extensible ladder 13 pivotally mounted by a main pivot 14 on upright extensions 15 on a rotatable table 16 which in turn is mounted on a table support member 17 positioned in elevated relation in the vehicle 10 adjacent the rear wheels 12 thereof by a vertical table support frame 18, the lower portion of which is secured to cross frame members 19 carried on a longitudinal frame 11 of the vehicle.

Still referring to FIGS. 1 and 2 of the drawings, it will be seen that housings 20 are positioned in outward and downward relation to the vertical table support frame 18 and the frame 11 of the vehicle. There are at least a pair of such oppositely disposed housings 20 on the vehicles. A telescopically movable leg 21 is positioned within each of the housings 20 and the outrigger extension of the present invention is attached to the lower end of each of the legs 21 and generally indicated in the drawings by the numeral 22. The vehicle 10 shown in FIGS. 1 and 2 of the drawings carries the vertical table support frame 18 at its rearmost end and as best seen in FIG. 1 of the drawings the side of the vehicle indicated by the letter S defines its maximum width with the broken line illustration showing the maximum sidewardly extensible position of the leg 21 and the outrigger extension 22.

As illustrated the housings 20 are fixed with respect to the vertical table support frame 18 and the vehicle frame 11, but it is possible and sometimes desirable to pivot the housings 20 at their upper innermost ends to the respective frames of the vehicle and in such instances power means are supplied to move the movable or swingable housings to the positions shown in the present disclosure. The outrigger housings 20 and the outrigger legs 21 are preferably tubular with the inner dimension of the outrigger housings 20 being slightly greater than the outer dimension of the outrigger legs 21 to provide relative sliding movement as best seen in FIG. 3 of the drawings.

Figure 5:
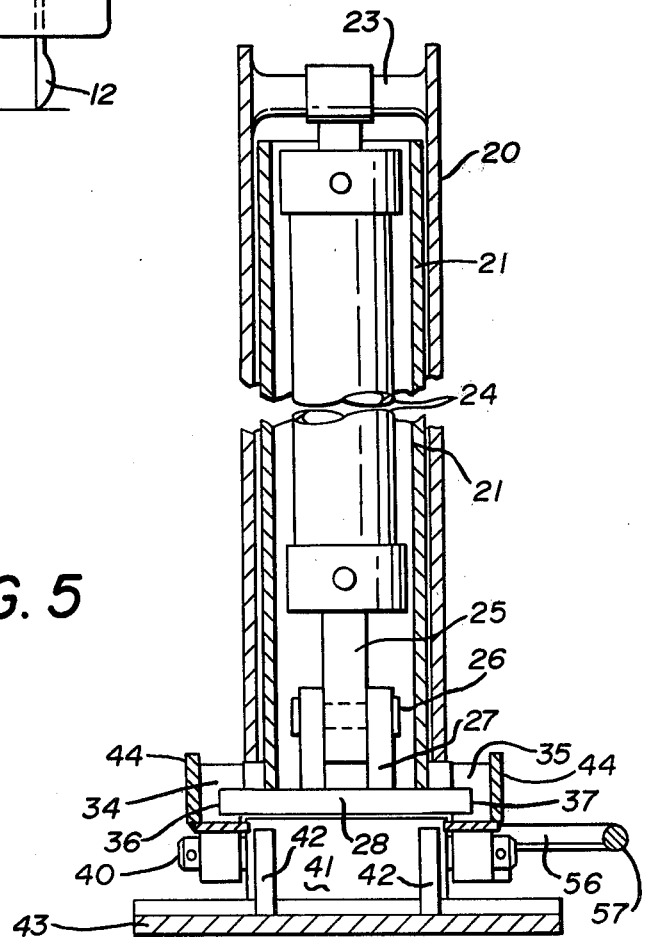
FIG. 5 is an end elevation with parts in cross section as seen on line 5—5 of FIG. 3.

By referring thereto, it will be seen that the upper end of the outrigger housing 20 carries a transverse pivot shaft 23 on which one end of a piston and cylinder assembly 24 is engaged with the piston rod 25 thereof extending to and pivotally engaged on a secondary pivot shaft 26 carried by a pair of spaced vertical extensions 27 on a plate 28 which is attached as by welding to the lower end of the leg 21 as also illustrated in FIG. 5 of the drawings. The arrangement is such that when fluid, such as hydraulic fluid, is supplied to the cylinder 24 by a source such as a pump, not shown, the leg 21 will be moved longitudinally of the housing 20 from an inward storage position to an extended downwardly and outward position to provide the desired lateral support of the vehicle and the ladder, boom or the like carried thereby. The piston and cylinder assembly 24 is double acting.

In order that the leg 21 may be secured in retracted relation to the housing 20, a depression 29 is provided in the leg 21 and a detent 30 in a tubular housing 31 is secured to the housing 20 in registry with an opening therein, a spring 32 in the tubular housing 31 tends to move the detent 30 into the depression 29 to yieldably hold the leg 21 in retracted position in the housing 20.

Figure 3:
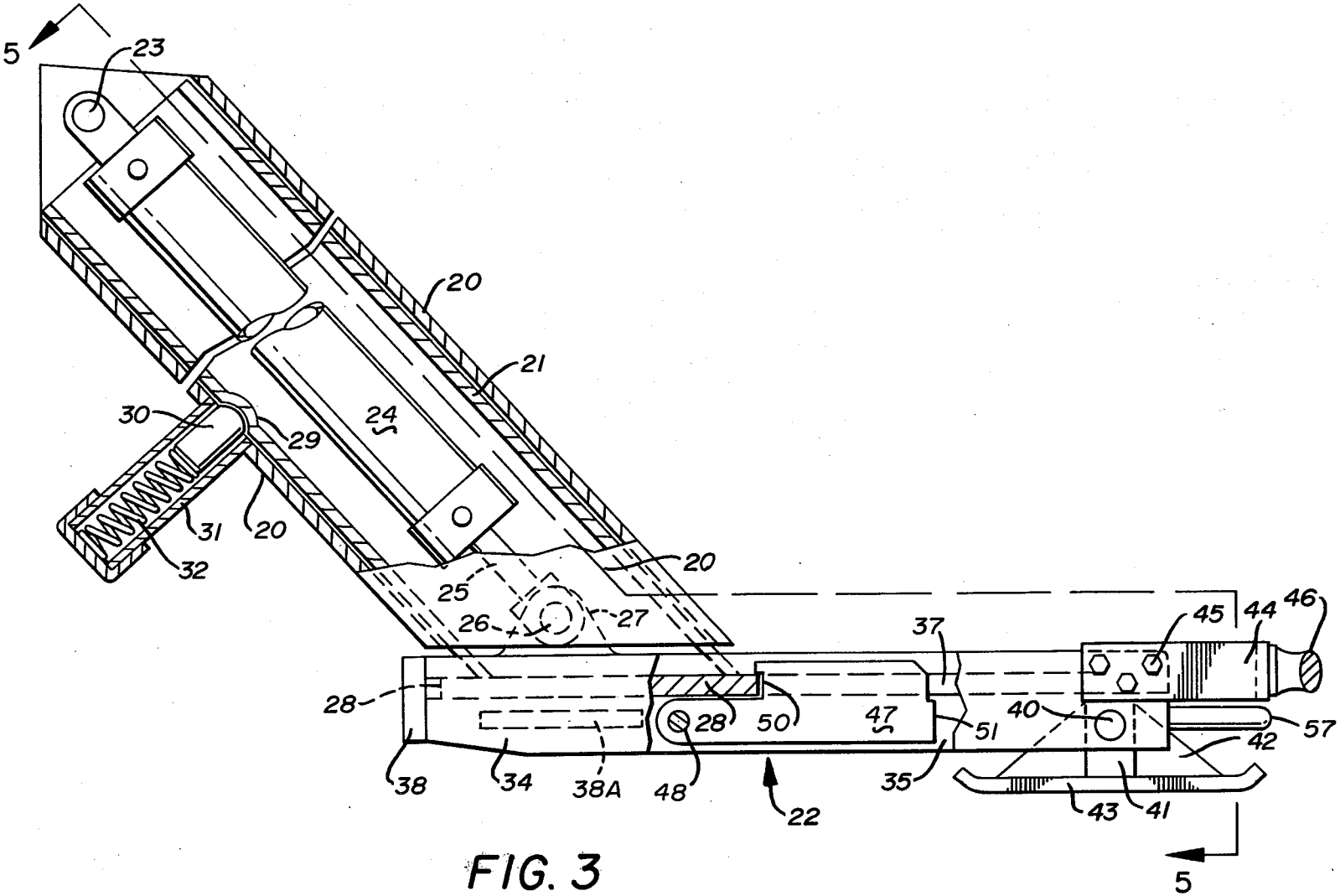
FIG. 3 is an enlarged cross sectional detail of the outrigger extension of the vehicle seen in FIGS. 1 and 2 of the drawings.
Figure 4:
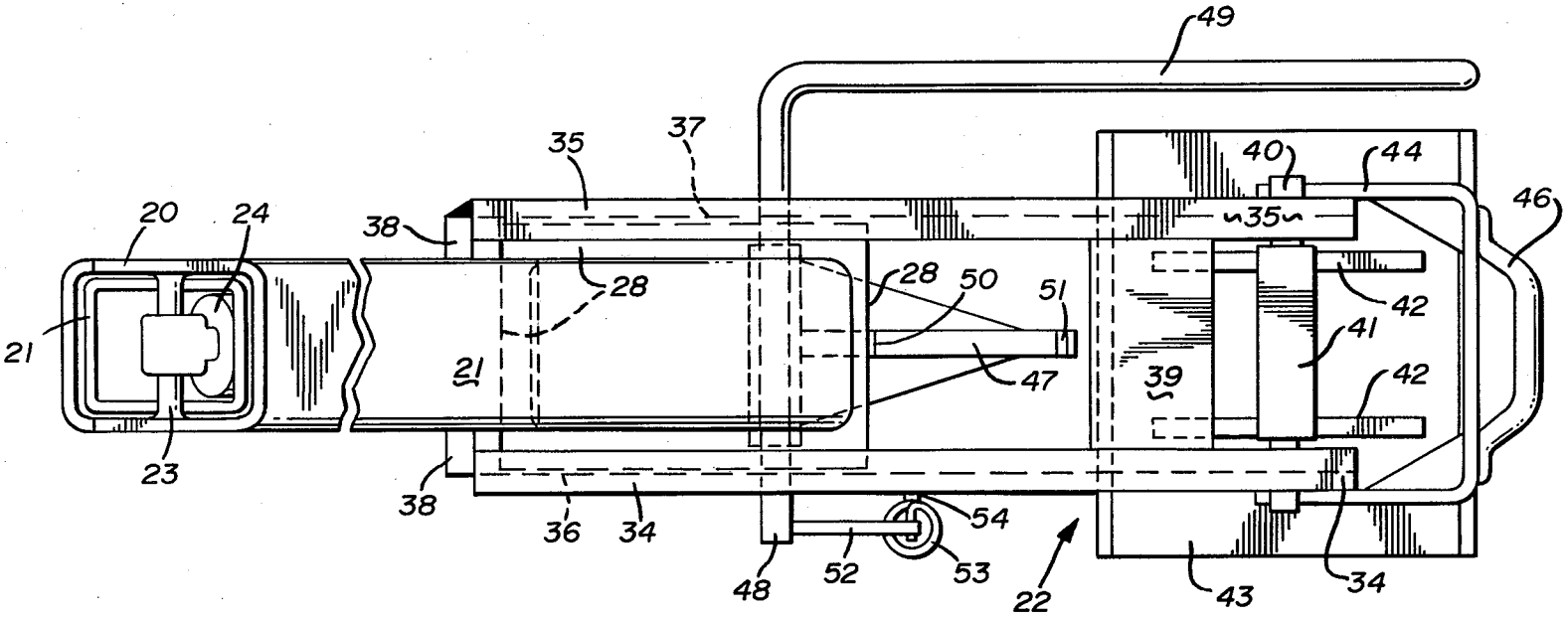
FIG. 4 is a top plan view of the outrigger extension seen in FIG. 3.

By referring to FIGS. 3, 4 and 5 of the drawings, the outrigger extension generally indicated at 22 will be seen to comprise the plate 28 attached to the angular bottom end of the leg 21 and providing a rigid support positioned transversely with respect to the vehicle 10 and slidably supporting parallel rails 34 and 35 on its opposite longitudinal edges, the parallel rails 34 and 35 having oppositely disposed grooves 36 and 37 therein in which the longitudinal edges of the plate 28 are engaged. The rails 34 and 35 are interconnected by cross members 38 and 38A and 39, and it will be observed that the rails 34 and 35 are thereby movable on a horizontal plane outwardly of the lower end of the leg 21 from a retracted position to an extended position, the retracted position being shown in solid lines in FIG. 1 of the drawings and the extended position being shown in broken lines in FIG. 1 of the drawings and in solid lines in FIGS. 3 and 4 of the drawings.

A pad support shaft 40 is engaged in the parallel rails 34 and 35 and extends therebetween and supports a pillow block 41 to which a pair of gusset plates 42 are attached. The lower surfaces of the pillow block 41 and the gusset plates 42 are attached to a ground engaging pad 43. Means is provided for moving the parallel rails 34 and 35 and the ground engaging pad 43 toward and away from the lower end of the housing 20 and its telescopically carried leg 21 and such means comprises a U-shaped bracket 44 attached to the opposite sides of the parallel rails 34 and 35 by fasteners 45 as best seen in FIG. 3 of the drawings so that the U-shaped bracket 44 extends horizontally and outwardly of the ends of the parallel rails 34 and 35.

A handle 46 is attached to the outermost portion of the U-shaped bracket 44 and provides a convenient hand hold by which the outrigger extension generally indicated at 22 may be manually moved.

In order that the outrigger extension 22 may be locked in outwardly extended position, a latch mechanism is incorporated and may be seen in FIGS. 3 and 4 of the drawings as comprising a latch plate 47 which is attached at one of its ends to a shaft 48 which extends through apertures in the oppositely disposed parallel rails 34 and 35 respectively with one of its ends extending at a right angle thereto so as to form a lever 49 which is normally positioned in parallel relation to the parallel rail 35 as best seen in FIG. 4 of the drawings. The latch plate 47 has a notch 50 inwardly of its point of attachment of the shaft 48 and arranged for registry over the end of the plate 28 which as heretofore described is attached to the lower end of the outrigger leg 21. The free end 51 of the latch plate 47 is spaced with respect to the shaft 48 sufficiently so that when the parallel rails 34 and 35 are retracted or moved to the left with respect to the outrigger leg 21, the free end 51 of the latch plate 47 will engage against the opposite end of the plate 28 and hold the outrigger extension 22 in retracted position. The latch plate 47 is unlatched from either its retracted or extended position by movement imparted the lever 49 which moves the latch plate 47 on the axis of the shaft 48 in an arcuate motion as best seen in FIG. 6 of the drawings.

Figure 6:
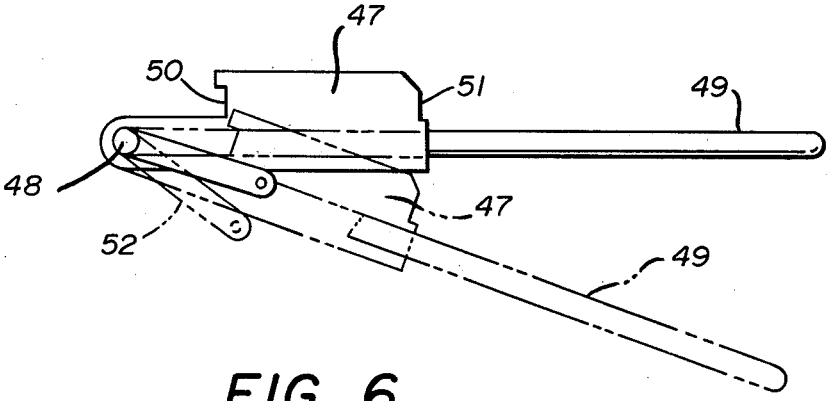
FIG. 6 is a side elevation of the latch mechanism seen in FIG. 4 of the drawings.

In order that the latch plate 47 will normally be held in latched position as seen in FIG. 6 and in FIGS. 3 and 4, a spring mechanism is provided which comprises an arm 52 attached to the shaft 48 and extending at right angles thereto. A spring 53 is connected between the outer end of the arm 52 and a fastener 54 engaged on the parallel rail 34 adjacent thereto as best seen in FIG. 4 of the drawings.

It will occur to those skilled in the art that the latch plate 47 as illustrated and described herein may be altered so that the portion of the latch plate 47 that engages the edge of the plate 28 may be arranged in the form of a notched upward extension for registry with apertures formed in the plate 28 if desired. Additionally a mechanical latch, not shown, may be added to the parallel rail 34 for engagement with the spring loaded arm 52 as will occur to those skilled in the art.

Figure 7:
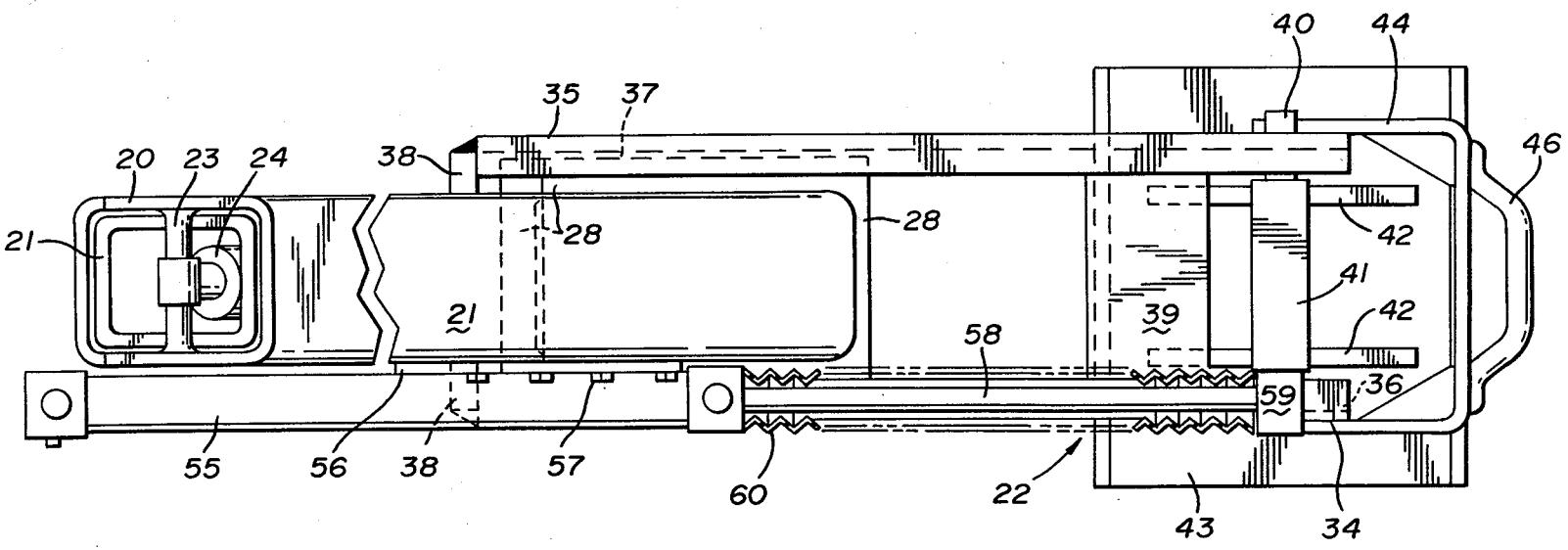
FIG. 7 is a top plan view of a modification showing power means for moving said outrigger system.

By referring to FIG. 7, it will be seen that the outrigger extension 22 may also be moved by power means such as a piston and cylinder assembly 55 which is attached by way of a bracket 56 to the leg 21 by a plurality of fasteners 57. The piston rod 58 extends out of the piston and cylinder assembly 55 and is attached at its outermost end to a block 59 which is positioned on the parallel rail 34 near its outer end. An accordion pleated flexible protective sleeve 60 is positioned over the rod 58. It will be observed that hydraulic fluid from a source not shown placed in communication with the piston and cylinder assembly 55 at its ends will move the piston rod 58 and the parallel rails 34 and 35 of the outrigger extension 22 and the ground engaging pad 43 thereon toward and away from the lower end of the outrigger leg 21. A rotatable screw on the leg 20 engaged in a threaded block on the outrigger extension 22 and driven by an electric or hydraulic motor may also be used.

It will thus be seen that an outrigger extension has been disclosed which comprises a manually or power operated device attached to the lower end of each of the outrigger legs of a vehicle so that the effective lateral spacing of the outrigger legs is substantially increased with respect to the vehicle on which the outrigger system is provided. In the case of a ladder carrying fire truck or a boom carrying truck, having a personnel carrier on the end of the boom and known in the art as a SNORKEL, the outrigger extension system enables the rotatable ladder or boom with its personnel carrier to be moved outwardly and sidewardly with respect to the carrying vehicle a substantially greater distance than has heretofore been posible as the extended point of contact with the ground at either side of the vehicle substantially improves the tipping moment and thereby enables the vehicle to remain in upright position and makes possible the more efficient operation of the extension ladder or personnel carrying boom as the case may be.

Although but one embodiment of the present invention has been illustrated and described, it will be apparent to those skilled in the art that various changes and modifications may be made therein without departing from the spirit of the invention and having thus described my invention what I claim is:

1. An improvement in a vehicle outrigger support for a vehicle, said vehicle having a frame with lateral sides with respect to its driving direction, said support comprising at least one housing on each side of said frame and means for securing said housing to the vehicle frame so that the housing extends angularly downwardly and outwardly from the vehicle frame; an outrigger leg movably positioned in said housing for movement between an upper inward storage position and a downward outward operative position, said leg having an outermost lower end and being of sufficient length so as to extend the outermost lower end to a position spaced closely to the ground outwardly of the adjacent lateral side of the vehicle when said leg is in its downward outward operative position; the improvement comprising means to increase the lateral stability of said vehicle, said means comprising a horizontally disposed support member on the outermost lower end of said outrigger leg, an outrigger extension slidably engaged for horizontal movement on said support member with respect to said outrigger leg between an inward storage position and an outward operative position, a support pad on said outrigger extension spaced outward from said support member that will engage the ground when said outrigger extension is in its outward operative position, means for latching said outrigger extension to said support member selectively in its outward operative position and inward storage position, and when said outrigger leg is extended, said housing, outrigger leg, and outrigger extension together forming a rigid beam cantilivered outwardly from the adjacent lateral side of the vehicle for supporting and stabilizing the same.

2. The improvement in a vehicle outrigger support of claim 1 including means operatively connected between said outrigger extension and said member for moving said outrigger extension between said outward operative position and said inward storage position.

3. The improvement in a vehicle outrigger support of claim 2 wherein said means operatively connected between said leg and said outrigger extension is a device having an extensible and retractable member with power means for moving the same.

4. The improvement in a vehicle outrigger support of claim 1, wherein said latch means includes a latch member pivotally mounted about a pivot on said outrigger extension, an abutment on said latch member, a shoulder on said support member in a position to engage said abutment in one of said outrigger extension positions to prevent relative movement between said support member and outrigger extension and means for moving said latch member about its pivot to disengage said abutment from said shoulder.

5. The improvement in a vehicle outrigger support of claim 4 wherein said support member and said latch member have, respectively, plural shoulders and abutments, for respective engagement in said inward storage and outward operative positions.

6. The improvement in a vehicle outrigger support of claim 1 wherein the support member for said outrigger extension includes a horizontally positioned rigid metal plate fastened to the lowermost portion of said leg, said plate having parallel longitudinal sides and said outrigger extension having opposed inwardly opening parallel grooves extending horizontally and receiving therein said parallel sides of said plate.

7. The improvement in a vehicle outrigger support of claim 1 wherein said outrigger extension consists of a pair of spaced parallel horizontally disposed rails, frame members interconnecting said rails, longitudinally extending configurations on said rails engaging said support means, a pivot shaft positioned between said rails, said support pad engaged on said pivot shaft.

8. The improvement in a vehicle outrigger support of claim 2 including a handle on said outrigger extension, said handle interconnecting said rails and positioned outwardly of one end of said outrigger extension.

* * * * *